United States Patent [19]

Masie et al.

[11] 4,251,704

[45] Feb. 17, 1981

[54] UNIT FOR INDUCTION HEATING AND HARDENING GEAR TEETH

[75] Inventors: James R. Masie, Cleveland; James J. Snyder, Sagamore Hills, both of Ohio

[73] Assignee: Park-Ohio Industries, Inc., Cleveland, Ohio

[21] Appl. No.: 24,683

[22] Filed: Mar. 28, 1979

[51] Int. Cl.[3] ..... H05B 6/14; H05B 6/40; C21D 1/10; C21D 9/32

[52] U.S. Cl. ..... 219/10.59; 219/10.79; 219/10.43; 266/125; 266/129; 148/147

[58] Field of Search ..... 219/10.59, 10.79, 10.75, 219/10.43, 8.5, 7.5, 6.5, 9.5, 10.57; 266/125, 129, 126, 124; 148/147, 150

[56] References Cited

U.S. PATENT DOCUMENTS

| | | | |
|---|---|---|---|
| 2,164,310 | 7/1939 | Denneen et al. | 266/125 |
| 2,167,798 | 8/1939 | Denneen et al. | 266/125 X |
| 2,797,288 | 6/1957 | Kiemele et al. | 219/8.5 |
| 3,031,555 | 4/1962 | Ross et al. | 219/10.79 |
| 3,185,808 | 5/1965 | Sorensen et al. | 219/10.43 |
| 3,236,993 | 2/1966 | Jones | 219/10.59 |
| 3,446,495 | 5/1969 | Pfaffman et al. | 266/125 |
| 3,532,333 | 10/1970 | Dehn | 266/125 |
| 3,777,097 | 12/1973 | Budzinski | 219/10.59 |

FOREIGN PATENT DOCUMENTS

| | | | |
|---|---|---|---|
| 1211674 | 3/1966 | Fed. Rep. of Germany | 219/10.59 |

*Primary Examiner*—C. L. Albritton
*Assistant Examiner*—Philip H. Leung
*Attorney, Agent, or Firm*—Meyer, Tilberry & Body

[57] ABSTRACT

An induction heating unit is disclosed which is operable to inductively heat and harden teeth on circumferentially extending radially thin flange segments of a gear. The unit includes an inductor conforming in circumferential contour and length to the flange segment and having radially and axially offset conductor leg portions to control heating of the gear teeth during relative axial scanning movement between the gear and inductor so as to prevent distortion of the gear flange. The unit further includes an arrangement for quenching the gear teeth and cooling the end portions of the flange segment during scanning movements.

8 Claims, 6 Drawing Figures

FIG. 3
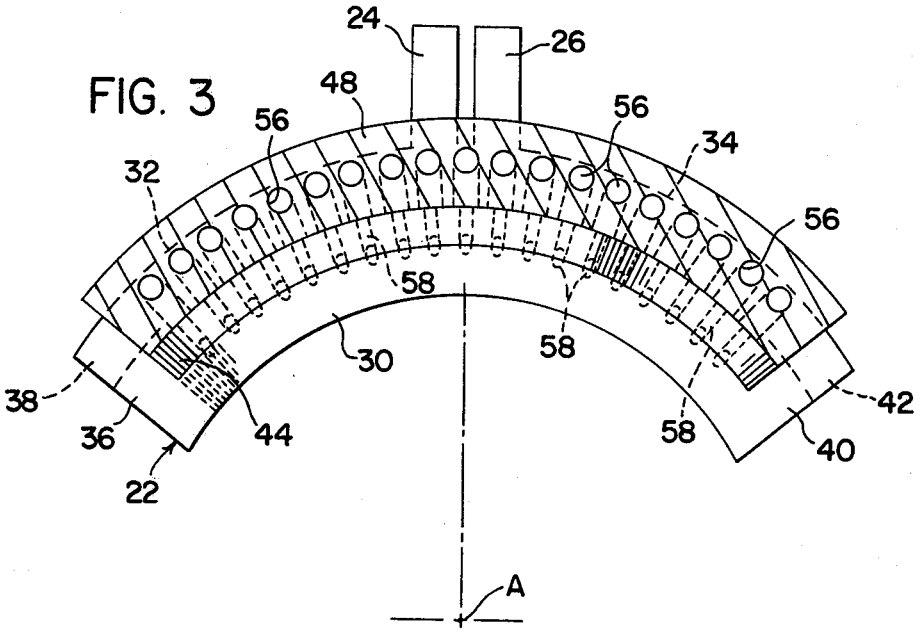
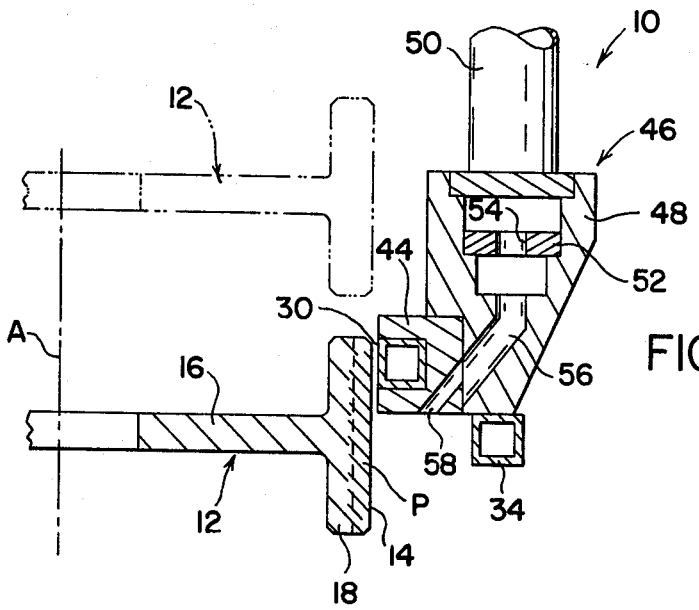
FIG. 4

UNIT FOR INDUCTION HEATING AND HARDENING GEAR TEETH

BACKGROUND OF THE DISCLOSURE

The present invention relates to the art of induction heating and, more particularly, to the induction heating and hardening of gear teeth.

The present invention finds particular utility in connection with the induction heating and hardening of gear teeth on a gear which is characterized by a radially extending axially thin hub plate having a plurality of radially thin circumferentially extending flange segments extending thereabout and the teeth of which gear are on the outer surfaces of the flange segments. Accordingly, the invention will be described in detail in connection with a gear of this structure. At the same time, it will be appreciated that the invention is applicable to the hardening of teeth on other gear structures in which the teeth are on a radially thin circumferentially extending flange which may be supported other than by a radially extending circumferentially continuous hub plate.

Gears of the character having a radially extending hub plate supporting radially thin circumferentially extending gear flange segments having teeth on the radially outer sides thereof are of course well known. Such gears are employed for example in the automotive industry as synchronizing gears, the teeth of adjacent segments being circumferentially interrupted as required to provide a desired synchronizing function. In the use of such gears, clearances between the gear and components with which the gear is to be associated are minimal, whereby it becomes extremely important in connection with hardening the gear teeth to achieve a desired hardness pattern therein without distortion of either the teeth contour or the gear flange, either of which can lead to an unacceptable end product. Additionally, for reasons including the economics of production, it is desirable to achieve heating and hardening of a segmental portion of the teeth on such a gear by a noncircling inductor arrangement and by an axially scanning displacement between the inductor and gear for the heating to be axially progressive along the teeth from one axial end of the gear flange toward the other.

Inductors and induction heating units heretofore available for induction heating by such a scanning procedure do not enable satisfactorily achieving a desired hardness pattern along the outer ends of the gear teeth of such a gear without the distortion referred to above. In this respect, for example, the use of such previous equipment has resulted in overheating one end or the other of the gear teeth and thus a deviation from the desired heating pattern therealong. Other problems encountered have included insufficient heating of the teeth at the circumferentially opposite ends of the flange segment, a concave outer tooth surface, and undesirable heating into the flange and hub plate at the circumferentially opposite ends of the flange segment. The latter especially can cause flange distortion at the segment ends resulting in an increase in the outside diameter of the gear in these areas.

SUMMARY OF THE INVENTION

In accordance with the present invention, an induction heating unit is provided which enables the heating and hardening of a segmental portion of teeth on a gear flange to provide a desired heating pattern and hardness without tooth and/or flange distortion. More particularly, in this respect, the induction heating unit according to the present invention includes a unique inductor configuration which optimizes the efficient heating of the gear teeth during a scanning operation while avoiding overheating of the teeth at one or the other of the axially opposite ends thereof. In accordance with another aspect of the present invention, the induction heating unit includes a quenching arrangement associated with the inductor to achieve hardening during the scanning operation and to achieve cooling of the flange and hub plate at the circumferentially opposite ends of the segment of teeth being heated to avoid flange distortion in the latter areas. In accordance with a further aspect of the invention, the quenching arrangement advantageously provides for cooling flux concentrating material associated with the inductor.

The inductor according to the present invention is a tubular conductor having first and second leg portions which are axially offset with regard to the direction of scanning and radially offset with respect to the radially outer ends of the teeth on the gear flange. More particularly, the first or action heating leg portion is of a conductor and circumferential length corresponding to that of the segment of teeth to be heated and is adapted to be displaced in magnetically coupled relationship with respect to the gear teeth to inductively heat the latter. The second or return leg portion of the inductor is axially offset with respect to the first leg to optimize the intensity of the magnetic field between the heating leg and gear teeth, and is radially offset outwardly from the first leg a distance sufficient for the return leg portion to be magnetically decoupled with respect to the gear teeth during the scanning operation. Such decoupling advantageously prevents additional inductive heating of the gear teeth which would occur if the first and second leg portions were radially positioned in axial alignment with one another. Preferably, the first or heating leg is provided with a flux concentrating material to increase the flux density in the gear teeth during the heating operation. Preferably, the quenching arrangement includes a quenching liquid receiver structurally associated with the inductor so as to supplement the cooling thereof by the usual flow of cooling fluid through the tubular conductor. Additionally, the quenching liquid receiver is preferably structurally interrelated with the flux concentrating material on the heating leg so as to cool the flux concentrating material and simultaneously achieve a desired flow of the quenching liquid against the gear teeth during scanning to achieve hardening thereof.

It is an outstanding object of the present invention to provide an induction heating unit for inductively heating a circumferential segment of gear teeth on a radially thin gear flange to achieve a desired heating pattern without distortion of the gear teeth and/or flange.

Another object is the provision of an induction heating unit of the foregoing character which includes a unique inductor configuration to optimize achieving a desired heating pattern along the lengths of the teeth and circumferentially of the segment of the teeth being heated.

Yet another object is the provision of an induction heating unit of the foregoing character which provides for cooling circumferentially opposite end portions of a segmental flange during the heating of gear teeth on the flange segment so as to prevent flange distortion in the end areas of the segment.

A further object is the provision of an induction heating unit of the foregoing character which includes a quenching arrangement associated with the inductor to achieve supplemental cooling of the inductor and hardening of the gear teeth.

Yet a further object is the provision of an inductor heating unit of the foregoing character in which the quenching arrangement is structurally associated with the inductor to cool flux concentrating material associated with the active leg portion of the inductor.

Still another object is the provision of an induction heating unit of the foregoing character in which the quenching arrangement includes liquid outlets for cooling the circumferentially opposite ends of the gear flange segment.

Yet another object is the provision of an induction heating unit of the foregoing character which is structurally simple and compact, economical to produce and operate and which is efficient and reliable in operation.

BRIEF DESCRIPTION OF THE DRAWING

The foregoing objects, and others, will in part be obvious and in part pointed out more fully hereinafter in conjunction with the description of a preferred embodiment of the invention illustrated in the accompanying drawings in which:

FIG. 3 is a plan view in section of the induction heating apparatus taken along line 3—3 in FIG. 2 and showing the quenching liquid outlets through the flux concentrating material;

FIG. 4 is a sectional elevation view of the induction heating unit taken along line 4—4 in FIG. 1;

DESCRIPTION OF PREFERRED EMBODIMENT

Figure 1:
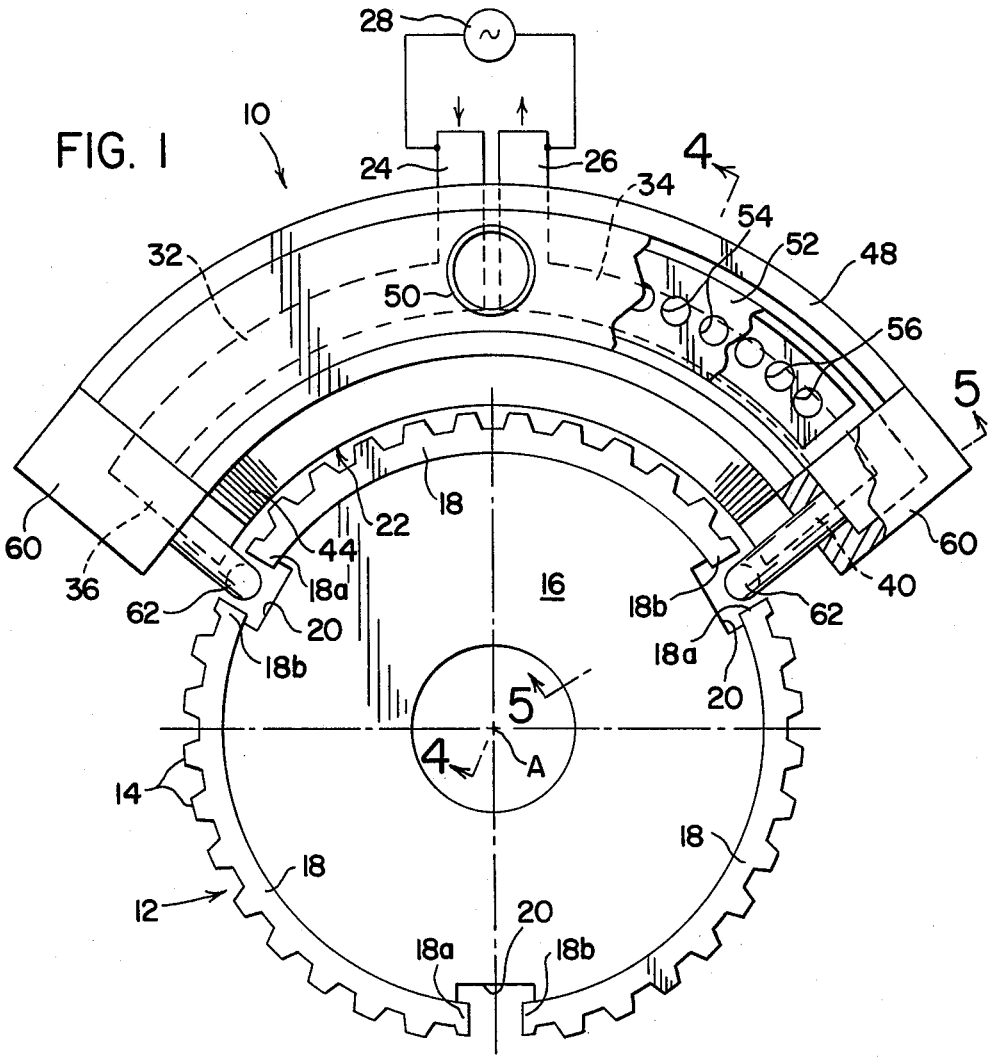
FIG. 1 is a plan view of an induction heating unit according to the present invention disposed in magnetically coupling relationship with teeth on a circumferentially extending flange segment of a synchronizing gear.

Referring now in greater detail to the drawings wherein the showings are for the purpose of illustrating a preferred embodiment of the invention only and not for the purpose of limiting the invention, an induction heating unit 10 is shown in association with a gear 12 having teeth 14 to be inductively heated and hardened by relative scanning displacement between the gear and induction heating unit, as set forth more fully hereinafter. In the embodiment illustrated, gear 12 has an axially thin radially extending hub plate 16 and three radially thin flange segments 18 extending about the outer periphery of plate 16. Each flange segment 18 has an axial length greater than the radial thickness thereof, and a like number of teeth 14 are provided on the radially outer side of each flange segment and extend axially thereof. Further in the embodiment shown, each flange 18 has circumferentially opposite end portions **18*a* and 18*b*, and hub plate 16 is recessed radially inwardly and is circumferentially undercut at ends 18*a* and 18*b* to provide slots 20 between the circumferentially adjacent flange segments. As set forth more fully hereinafter, gear teeth 14 of a flange segment 18** are inductively heated axially progressively therealong by relative axial displacement between the gear and induction heating unit.

Figure 6:
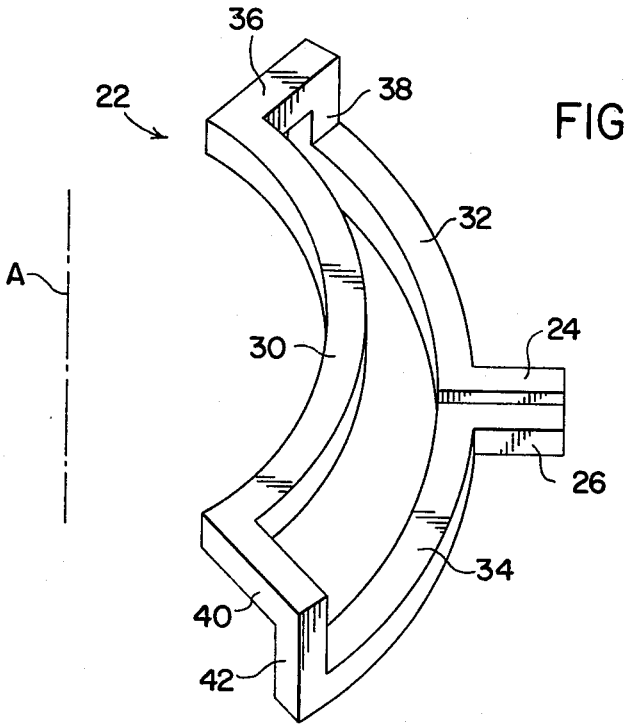

Induction heating unit 10 has an axis A which coincides with the axis of a gear 12 during an induction heating operation, and includes an inductor 22 comprised of a continuous tubular conductor of copper, or the like. Inductor 22 has terminal end portions 24 and 26 connectable across a suitable source of alternating current 28 for energization of the inductor and, as is well known, the tubular structure of the conductor facilitates the circulation of cooling fluid therethrough. Accordingly, it will be appreciated that end portions 24 and 26 are adapted to be connected to a source of cooling fluid, not illustrated Inductor 22, which is shown alone in FIG. 6, further has to provide a first or active leg portion 30 and a second or inactive leg portion which, in the embodiment illustrated, is defined by inductor portions 32 and 34 extending in circumferentially opposite directions from terminal end portions 24 and 26, respectively. Leg portion 30 has a curvature with respect to axis A corresponding to the curvature of flange 18 and has a circumferential dimension between its opposite ends so as to extend between adjacent slots 20 of gear 12. Inductor portions 32 and 34 have circumferentially outer ends generally aligned radially with a corresponding end of leg portion 30 and interconnected therewith by corresponding bridging inductor portions. More particularly in this respect, one end of leg portion 30 is interconnected with the corresponding end of inductor portion 32 by a radially outwardly extending bridging portion 36 and an axially extending bridging portion 38, and the other end of leg portion 30 is interconnected with the corresponding end of inductor portion 34 by a radially outwardly extending bridging portion 40 and an axially extending bridging portion 42. During an induction heating operation, the flange 18 of gear 12 and active leg portion 30 of inductor 22 are relatively displaced axially with leg portion 30 in magnetically coupled relationship with the gear flange, and the bridging portions at the opposite ends of leg portion 30 provide for the inactive leg portion of the inductor as defined by inductor portions 32 and 34 to be axially offset from leg 30 and to be offset radially outwardly therefrom, for the purposes set forth more fully hereinafter.

Preferably, active leg portion 30 of the inductor is provided with a C-shaped flux concentrator 44 extending circumferentially along leg portion 30 between the bridging portions 36 and 40 at the opposite ends thereof. The flux concentrator covers the axially opposite and radially outer sides of the tubular conductor providing leg portion 30 and, as is well known, operates during current flow through the conductor to concentrate the magnetic flux to increase the flux density in the workpiece being heated and to concentrate the current flow through leg portion 30 in the radially inner wall thereof.

Induction heating unit 10 further includes a quenching arrangement 46 for directing quenching liquid such as water against the gear flange during the induction heating operation. In the embodiment shown, the quenching arrangement includes a housing 48 providing a quenching liquid receiver which extends circumferentially between the opposite ends of inductor leg portion 30. The upper end of housing 48 is adapted to receive quenching liquid from a suitable source, not illustrated, such as by means of a conduit 50 opening into the housing, and a circumferentially extending liquid distributing plate 52 is provided within housing 48 and is provided with a plurality of openings 54 along the length thereof for distributing the quenching liquid circumferentially within the housing. Housing 48 is circumferentially recessed along the radially inner side thereof to receive the radially outer portion of flux concentrator 44, and the bottom side of housing 48 rests on the upper surface of inductor portions 32 and 34. The portion of housing 48 underlying distribution plate 52 is provided with a plurality of circumferentially spaced quenching liquid outlet passages 56, and the lower radially outer portion of flux concentrator 44 is provided with corresponding quenching liquid openings 58 communicating at their inner ends with housing passageways 56. Openings 58 are directed radially inwardly and downwardly of the induction heating unit to direct quenching liquid against gear flange 18 as set forth more fully hereinafter.

Figure 2:
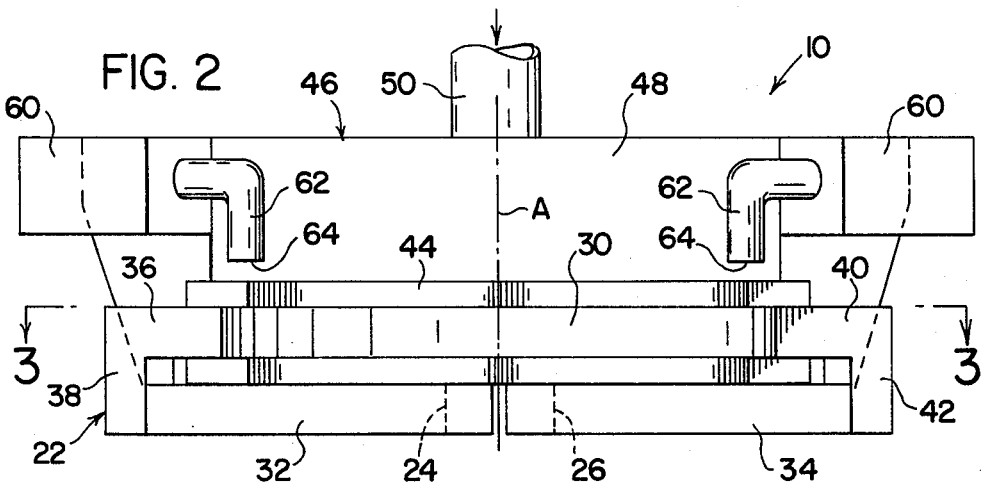
FIG. 2 is a front elevation view of the induction heating unit alone.
Figure 5:
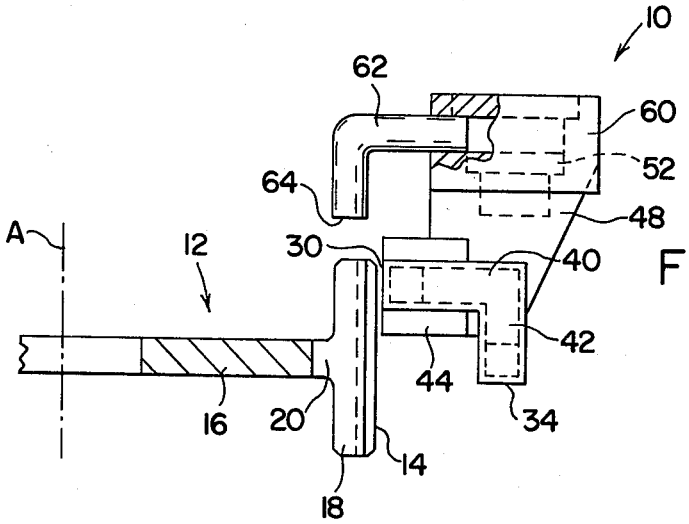
FIG. 5 is a sectional elevation view taken along line 5—5 in FIG. 1 and showing the end slot cooling liquid outlets; and, FIG. 6 is a perspective view of the inductor of the induction heating unit.

As best seen in FIGS. 1, 2 and 5, housing 48 of the quenching assembly is provided at the circumferentially opposite ends thereof with extensions 60 which are in fluid flow communication with the housing above distributing plate 52. Each extension 60 is provided with a corresponding discharge conduit 62 extending radially inwardly therefrom and thence downwardly to provide outlet ends 64 each overlying the corresponding slot area 20 of the gear, for the purpose set forth hereinafter.

As mentioned hereinabove, teeth 14 on a gear flange 18 are adapted to be inductively heated by relative axial scanning displacement between gear 12 and induction heating unit 10. Preferably, the induction heating unit is supported in an axially and radially fixed position and gear 12 is displaced axially relative to the induction heating unit for the teeth on flange segment 18 to be axially scanned during an induction heating operation. Apparatus for supporting an inductor and workpiece in the foregoing manner to achieve induction heating by scanning displacement of the workpiece is well within the skill of the art and forms no part of the present invention and, therefore, need not be disclosed in detail.

In connection with the operation of the preferred embodiment herein described, and with reference in particular to FIG. 4, gear 12 is initially disposed in the broken line position shown, whereby the lower end of flange 18 is above active leg portion 30 of the inductor. Further in connection with the preferred embodiment, the desired heating pattern P has a uniform radial depth with regard to the gear teeth and an axial length along the teeth slightly less than the axial dimension of the teeth, as shown by hatch lines in the solid line position of gear 12 in FIG. 4. To achieve the desired pattern, gear 12 is displaced downwardly and inductor 22 is energized at the appropriate time to initiate the induction heating operation adjacent the lower ends of the teeth. As gear 12 continues to move downwardly the teeth are progressively heated axially in the direction from the bottom of flange 18 towards the top thereof, and inductor 22 is de-energized at the appropriate time to terminate the induction heating at the desired point adjacent the top ends of the teeth. During the downward scanning movement of the gear, quenching liquid is directed through passageways 56 and openings 58 and against the teeth to achieve hardening thereof. At the same time, quenching liquid is discharged through conduits 62 against the circumferentially opposite ends of flange 18 and onto heat plate 16 in the slot areas 20 to maintain the latter areas of the gear cool during the induction heating operation. Following completion of the preceding procedure, gear 12 is axially displaced upwardly to its initial position and indexed circumferentially to position another flange segment relative to the induction heating unit for inductively heating and hardening the teeth on the latter flange segment upon subsequent scanning displacement of gear 12 relative to the induction heating unit.

In connection with the induction heating and quenching operation described above, the axial offset of the inactive leg portion of the inductor relative to active leg portion 30 advantageously optimizes flux concentration and the density of the flux field between leg portion 30 and gear teeth 14. In this respect, the inductor configuration provides for the directions of the magnetic fields in inductor portions 32 and 34 to be opposite that in leg portion 30 as current flows through the tubular conductor, thus promoting a cancelling effect. Such cancelling effect is minimized by the axial offset between leg portion 30 and portions 32 and 34. The radial offset between leg portion 30 and portions 32 and 34 also serves the latter purpose and, additionally, radially spaces portions 32 and 34 from gear flange 18 a distance to achieve decoupling therewith. This advantageously avoids undesirable supplemental inductive heating of the gear teeth by the inductor portions 32 and 34 and thus enables better control of the heating pattern with respect to both the radial depth and axial extent thereof along the gear teeth. At the same time, the axial and radial offset between the inactive and active leg portions of the inductor advantageously accommodates the housing of the quenching assembly and a construction of the latter which enables quenching liquid flow through the flux concentrator on the active leg of the inductor and in the area between the active and inactive legs thereof and thence against the gear teeth. This relationship advantageously provides for the quenching liquid to cool the flux concentrator and to supplement the primary cooling of the tubular conductor which is achieved by the flow of coolant therethrough. Still further, the flow of quenching liquid between the inactive leg portion of the inductor and the gear flange, and the splashing of quenching liquid against the inactive leg as a result of impingement of the liquid on the gear teeth, advantageously further cools the inactive leg portion. The supplemental cooling provided by liquid flow through conduits 62 into the slot areas 20 at the circumferentially opposite ends of flange segment 18 advantageously cools the terminal ends of the flange segment and the surface areas of hub plate 16 adjacent slots 20 to prevent distortion of flange 18 in these areas while enabling the intensity of heat required to achieve the desired heating pattern with respect to the endmost teeth on flange 18.

While considerable emphasis has been placed herein on a specific structure of component parts of the preferred embodiment of the induction heating unit, it will be appreciated that many changes therein will be obvious and suggested and can be made without departing from the principles of the present invention. Accordingly, it is to be distinctively understood that the foregoing descriptive matter is to be interrupted merely as illustrative of the present invention and not as a limitation.

Having thus described the invention, it is claimed:

1. An induction heating unit for inductively heating a peripheral segment of teeth on circumferentially extending flange means of a gear having an axis and which flange means has a radial thickness and an axial length greater than said thickness, said heating being axially progressive along said flange means by relative axial scanning displacement between said flange means and heating unit, said unit including an inductor comprising a tubular conductor having opposite ends connectable to a source of power, said inductor including first and second leg portions between said opposite ends, said first leg portion having a circumferential contour and length to inductively heat said peripheral segment of teeth when disposed in magnetically coupled relationship with said flange means, and said second leg portion being axially and radially offset with respect to said first leg portion, said radial offset providing for said second leg portion to be in magnetically decoupled relationship with said flange means when said first leg portion is disposed in magnetically coupled relationship therewith, said axial offset being in the direction to provide for said second leg portion to trail said first leg portion with regard to the direction of axial heating, and means for directing a quenching liquid between said first and second leg portions and radially toward said flange means.

2. An induction heating unit according to claim 1, and flux concentrating means on said first leg portion of said inductor.

3. An induction heating unit according to claim 2, wherein said means for directing quenching liquid includes quenching liquid receiving means, and openings through said flux concentrating means communicating with said receiving means and directing liquid therefrom towards said flange means.

4. An induction heating unit according to claim 1, wherein said flange means has circumferentially opposite end portions, and means for directing cooling liquid against each said end portion.

5. An induction heating unit according to claim 4, and flux concentrating means on said first leg portion of said inductor.

6. An induction heating unit according to claim 5, wherein said means for directing quenching liquid includes quenching liquid receiving means and openings through said flux concentrating means communicating with said receiving means and directing liquid therefrom toward said flange means, and said means for directing cooling liquid includes a pair of conduits each communicating with said receiving means and having an outlet end for directing liquid from said receiving means toward a corresponding one of said end portions of said flange means.

7. An induction heating unit according to claim 1, and further including flux concentrating means on and circumferentially coextensive with said first leg portion of said inductor and extending along the axially opposite sides thereof and the side radially spaced furtherest from said flange means, circumferentially extending quenching liquid receiving means having portions juxtaposed with respect to said flux concentrating means and said second leg portion of said inductor, said flux concentrating means including a plurality of circumferentially spaced apart flow passageways therethrough having inlet ends opening into said receiving means and outlet ends for directing liquid from said receiving means radially and axially toward said flange means.

8. An induction heating unit according to claim 7, wherein said flange means has circumferentially opposite end portions, and a pair of conduits each having an inlet end opening into said receiving means and an outlet end for directing fluid from said receiving means toward a corresponding one of said end portions of said flange means.

* * * * *